United States Patent [19]

Tanino et al.

[11] Patent Number: 5,074,385

[45] Date of Patent: Dec. 24, 1991

[54] CALL REGISTRATION APPARATUS IN AN ELEVATOR SYSTEM

[75] Inventors: Junichi Tanino; Hideyo Ujihara, both of Aichi, Japan

[73] Assignee: Mitsubishi Denki Kabushiki Kaisha, Japan

[21] Appl. No.: 542,716

[22] Filed: Jun. 25, 1990

[30] Foreign Application Priority Data

Jul. 26, 1989 [JP] Japan ..... 1-193081

[51] Int. Cl.[5] ..... B66B 1/14

[52] U.S. Cl. ..... 187/121; 187/103; 187/135

[58] Field of Search ..... 187/1 R, 125

[56] References Cited

U.S. PATENT DOCUMENTS

| | | | |
|---|---|---|---|
| 4,832,157 | 5/1989 | Kitano | 187/1 R |
| 4,846,310 | 7/1989 | Tanino | 187/121 |
| 4,858,727 | 8/1989 | Tanino | 187/121 |

*Primary Examiner*—A. D. Pellinen
*Assistant Examiner*—Lawrence E. Colbert
*Attorney, Agent, or Firm*—Leydig, Voit & Mayer

[57] ABSTRACT

A call registration apparatus for an elevator system includes a call registration lamp and a car call button disposed in an elevator car and connected by a common signal line to a CPU. When the call button is pressed a first time, the CPU registers a call and turns on the call registration lamp. When the elevator car reaches a floor, the CPU makes the call registration lamp flicker. If the call button is pressed while the lamp is flickering, the CPU performs a door opening or door closing operation.

12 Claims, 2 Drawing Sheets

CALL REGISTRATION APPARATUS IN AN ELEVATOR SYSTEM

BACKGROUND OF THE INVENTION

1. Field of the Invention

The present invention relates to a call registration apparatus for an elevator system in which a single signal line is used for a call button and a call registration lamp in an elevator cage.

2. Description of the Prior Art

Call registration apparatuses for elevators include so-called two-line type call registration apparatuses in which individual signal lines are used for a call button and for call registration lamp and so- called one-line type call registration apparatuses in which single signal line is used for a call button as well as a call registration lamp.

FIG. 4 is a circuit diagram showing the main portions of a one-line type call registration apparatus in which one end of a call button 1 is connected to ground and a signal line 7 is led out from the other end of the call button 1. One end of each of a call registration lamp 2 and a relay 10 are connected to the signal line 7. The other end of the call registration lamp 2 is connected to a DC source and the other end of the relay 10 is connected to the DC source through a contact which is made to open when a cage arrives at a floor. The signal line 7 is connected to ground through a normally open contact 11 of the relay 10.

When a user of an elevator pushes the call button 1, in FIG. 4 the call registration lamp 2 is turned on and the relay 10 is excited. The excitation of the relay 10 makes the contact 11 close to form a self-holding circuit, so that the relay 10 is self-held even if the call button 1 is released. Thus, a call is registered and the call registration lamp 2 is kept in its lighted state. When the elevator stops at the floor in response to the call, the contact 12 is opened so that the self holding of the relay 10 is released and the call is also canceled so that the call registration lamp 2 is turned off.

In an elevator system provided in a building for use for numbers of unspecified users, it is advantageous from the standpoint of simplification and is used only for use to provide single-functional operation buttons on an car operating panel such that, for example, a call button is used only for registering a call, a door open button is used only to open a door, a door close button has only a function to close the door, and so on.

On the other hand, in a so-called home elevator system, which is an elevator system provided for home use there is no particular problem even if each button can be used to perform a plurality of functions. For example, a button provided on an car operating panel acts as a call button as well as a door close button because only specified persons use the elevator system. The provision of such a configuration reduces the cost of the elevator system in portion to the reduction in the number of operating buttons.

In a configuration in which the circuit is arranged to use the same signal for call registration and door closing by a single pushing operation of an operating button, however, a user may sometimes become confused. There is no trouble even if the door closing is performed at the same time that call registration is made by a person who gets into a cage. However, in the case where a user who has gotten into a cage has registered a call for the third floor and, the cage stops at the second floor in response to a hall call at the second floor and another user going to the third floor gets into the cage at the second floor, it is impossible to perform door closing by means of the call button because call registration has already been made.

In this regard, it is desirable to make the circuit arrangement such that call registration is performed when an operating button is pushed once and door closing is performed when the same operating button is pushed again.

In the above-mentioned conventional one-line type call registration apparatus, however, there has been the problem that if the call registration lamp 2 has been once turned on by the depression of the call button 1, the state of the signal line 7 cannot be changed even if the call button 1 is pushed again and it is therefore impossible to add a new operational function to the call button 1.

SUMMARY OF THE INVENTION

It is therefore an object of the present invention to solve the above-mentioned problem in the prior art.

It is another object of the present invention to provide a call registration apparatus in which a call button can be used for door closing or the like even when a single signal line is used in common by a call button and a call registration lamp.

In order to attain the above objects, the call registration apparatus according to the present invention is arranged in a manner so that a call registration lamp is turned on in response to pushing operation of a car call button and the call registration lamp is made to flicker. If the call button is pressed a second time while the lamp is flickering, a door closing or door opening operation is performed.

In the call registration apparatus according to the present invention, the state of a signal line used in common by a call button and a call registration lamp is switched between a state in which the electrical potential is high and another state in which the electrical potential is low for a period during which the call registration lamp is made to flicker. In this period, if the call button is pushed again, the signal line is made to be in the same state as that caused when the call registration was first performed. At this time, however, since call registration has already been made, it is possible to distinguish the second operation of the button from the first time operation. Accordingly, a signal obtained by the second operation of the button can be used for promoting door closing operation when the door is open for reopening the door when the door is closed or the like.

BRIEF DESCRIPTION OF THE DRAWINGS

Other features and advantages of the present invention will be apparent from the following description considered in connection with the accompanying drawings, wherein.

DETAILED DESCRIPTION OF THE PREFERRED EMBODIMENT

Figure 1:
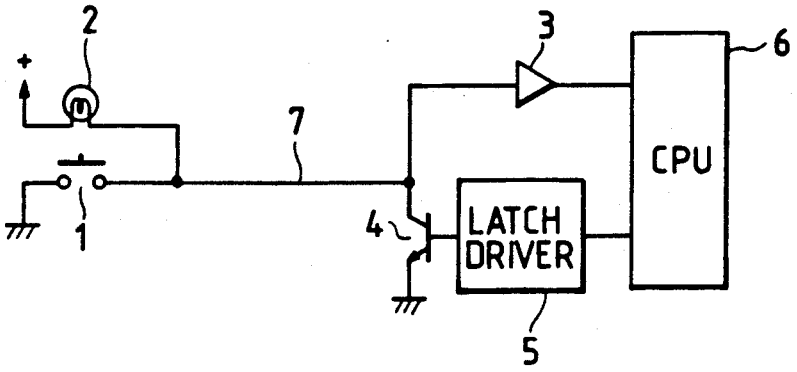
FIG. 1 is a circuit diagram of an embodiment of the call registration apparatus according to the present invention.

FIG. 1 is a circuit diagram showing the configuration of an embodiment of the call registration apparatus according to the present invention. In FIG. 1, a signal line 7 to which a call button 1 and a call registration lamp 2 are connected in common is connected to an input terminal of a CPU 6 through a receiver 3 so that a signal corresponding to the state of the signal line 7 can be input to the CPU 6. On the other hand, an output of the CPU 6 is connected to the base of a transistor 4 through a latch driver 5. The emitter and collector of the transistor 4 are connected to ground and the signal line 7, respectively. Thus, the CPU 6 can to perform lighting operation of the call registration lamp 2.

Figure 2:
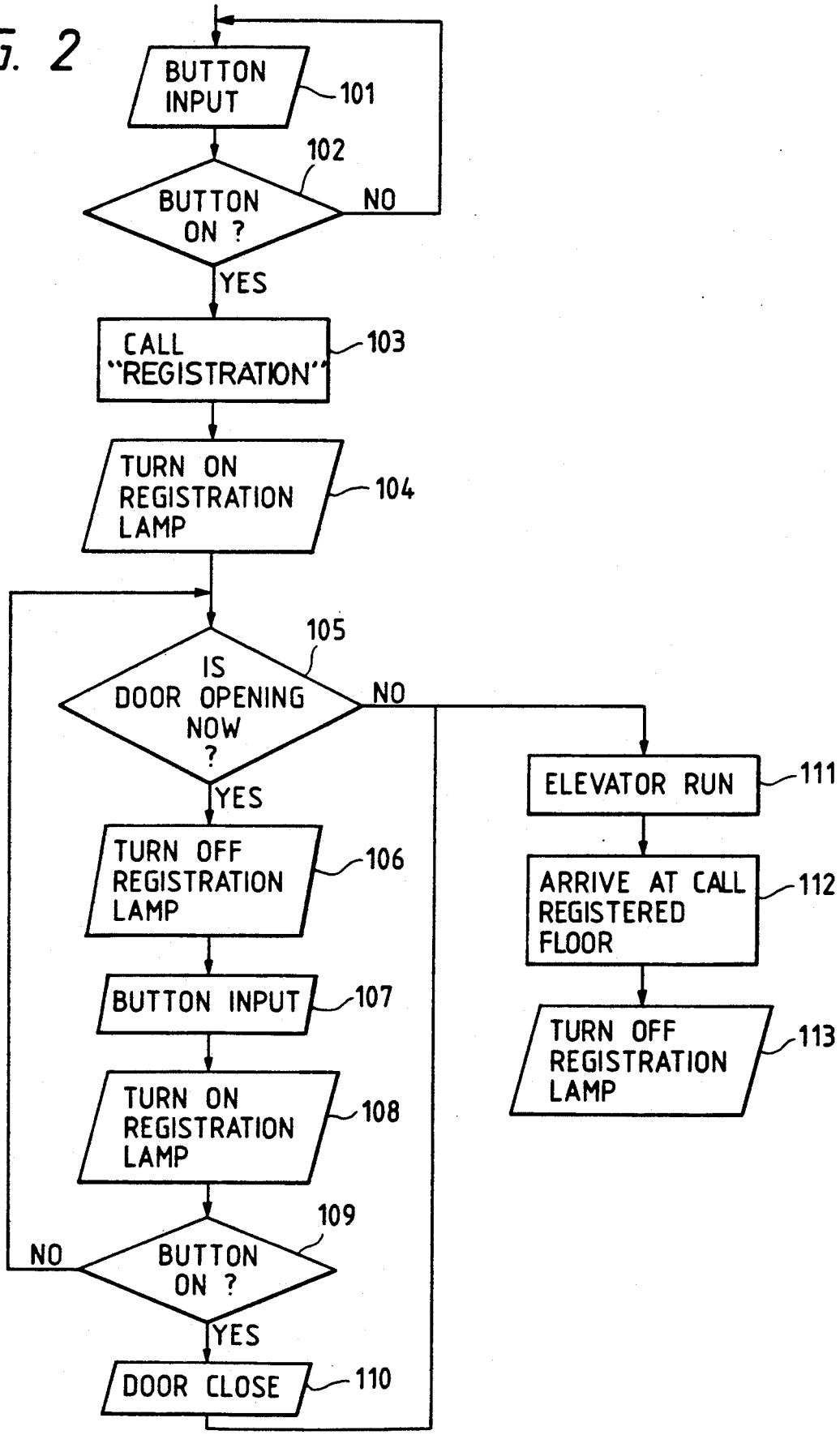
FIG. 2 is a flow chart of the operation of the embodiment of FIG. 1.

The operation of the embodiment of FIG. 1 will now be described while referring to the flow chart of FIG. 2, which illustrates the processing performed by the CPU 6, and the wave form diagram of FIG. 3.

First, in the initial state where the call button 1 is in the open state and the transistor 4 is in the off state, the input to the receiver 3 is at a high level (hereinafter simply referred to as "H"). If the call button 1 is momentarily pushed by a user in this state (Step 101 in FIG. 2), the input to the receiver 3 is changed to a low level (hereinafter simply referred to as "L"). By this change in level of the input to the receiver 3, the CPU 6 recognizes the button input and registers the call (Steps 102 and 103). Subsequently, the CPU 6 supplies a registration signal to the latch driver 5 so as to turn on the call registration lamp 2 (Step 104).

At that time, assuming that the door is opened by a command from a control board, the CPU 6 recognizes the door opening and deenergizes the latch driver 5 to turn off the call registration lamp 2 (Steps 105 and 106), whereby the receiver 3 is made to be in a condition in which a signal from the call button can be supplied to the receiver 3.

However, if the call registration lamp 2 is kept in the off state, the user may be given such an impression that the call registration has been canceled. Accordingly, the CPU 6 supplies a lighting command to the latch driver 5 and executes the above-mentioned processing so as to make the call registration lamp 2 flicker until the call button 1 is pushed again. If the call button 1 is pushed again, the CPU 6 makes the call registration lamp 2 turn and promotes the closing operation of the door, which is in the open state (Steps 107 through 110).

Next, upon completion of the door closing operation, the CPU 6 issues a command to make the elevator run (Step 111), and subsequently makes the call registration lamp 2 turn off when the elevator arrives at the call registered floor.

Figure 3:
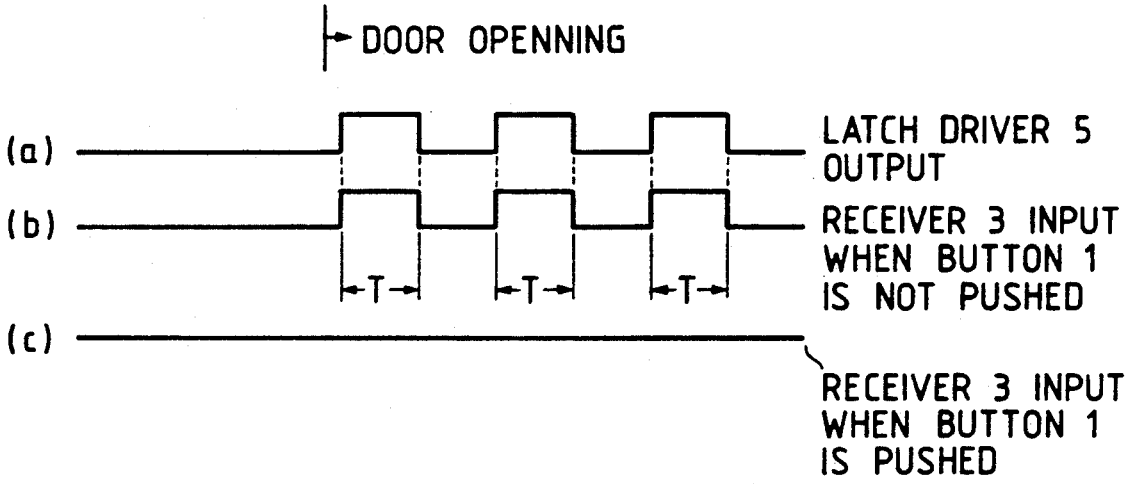
FIG. 3 is a time chart for the operation of the embodiment of FIG. 1.
Figure 4:
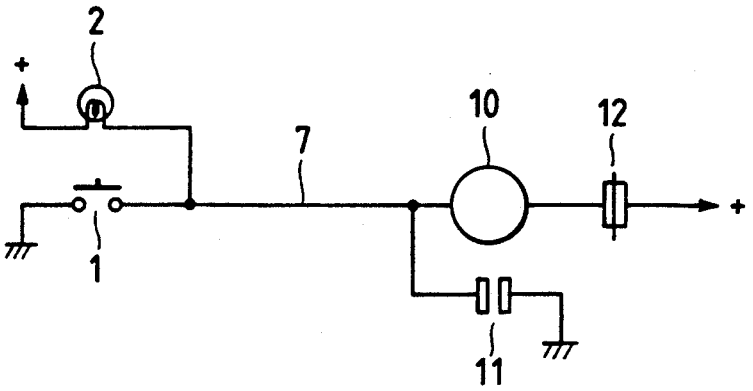
FIG. 4 is a circuit diagram showing the configuration of the call registration apparatus in a conventional elevator system.

FIG. 3 shows the respective states of the output of the latch driver 5 and the input of the receiver 3 while the above operation is being performed. When the door begins to open when the call registration is made by the call button 1, the output of the latch driver 5 changes alternatively between "H" and "L" as shown in FIG 3(*a*) so as to make the call registration lamp 2 flicker. During this period unless the call button 1 is pushed, the input of the receiver 3 also changes alternatively between "H" and "L" as shown in FIG. 3(*b*). If the call button 1 is pushed, the input of receiver 3 is kept "L", as shown in the FIG. 3(*c*), regardless of the state of the output of the latch driver 5.

Thus, according to this embodiment, the call registration lamp is turned on or lighted when the call button is pushed a first time, and then the call registration lamp is made to flicker if the door is opened in this state. If the call button is pushed again when the call registration lamp is flickering, the door closing operation is promoted. If the call button is not pushed when the call registration lamp is flickering, door closing is begun after the lapse of a predetermined time, such as, 10 seconds. At the same time, the call registration lamp is returned to its lighted or on state. The call registration lamp is turned off when the cage arrives at the call registered floor.

In the above-described; embodiment, the call registration lamp is made to flicker when the door is in the open state in order to enable the call button to be used for call registration as well as for closing the elevator door However, the call button can be used for call registration as well as for door reopening operation if the configuration is made such that the call registration lamp is made to flicker from the beginning to the end of the door closing operation and the door is opened again if the call button is pushed again in the period when the call registration lamp is flickering.

Further, in the above-described embodiment the call registration lamp is made to flicker with such a period that the flickering can be recognized by a user. However, if necessary, the period of flickering may be set to 10 msec or less so that the flickering state cannot be distinguished by human eyes from the continuous lighting state.

It is possible to make the configuration such that the call registration lamp is continuously lit only in response to a call registration, such that the call registration lamp is made to flicker with a short period when the door is open after call registration, and such that the call registration lamp is made to flicker with a long period when the door is closed after call registration. In this case, depressing the call button when the call registration lamp is flickering with a short period causes the door to close, and depressing the call button when the call registration lamp is flickering with a long period causes the door to reopen.

As will be apparent from the above description, according to the present invention, a call registration lamp is turned on when a car call button is pushed and the call registration lamp is made to flicker for a period during which a predetermined condition is satisfied. Accordingly, even in a one-line type call registration apparatus, a call button can be used for multiple functions.

What is claimed is:

1. A single-line call registration apparatus for a multi-floor elevator system comprising:

registration request means disposed in an elevator cage for requesting registration of a desired destination;

indicating means disposed in the elevator cage for indicating registration of the destination, the indicating means having a first and second indicating modes;

a signal line; and control means for registering the desired destination and controlling the indicating means to operate in its first indicating mode when the registration request means is operated a first time, controlling the indicating means to operate in its second indicating mode when the elevator cage reaches a floor of the elevator system, and performing a door control operation when the registration request means is operated a second time with the indicating means operating in its second indicating mode, the control means being connected to the registration request means and the indicating means by the signal line.

2. An apparatus as claimed in claim 1 wherein the registration request means comprises a button for call registration, and the indicating means comprises a lamp for indicating call registration.

3. An apparatus as claimed in claim 2 wherein the control means comprises means for continuously lighting the lamp in the first indicating mode and making the lamp flicker in the second indicating mode.

4. An apparatus as claimed in claim 3 wherein the lamp flickers in the second indicating mode with a period such that the lamp appears to be continuously lit.

5. An apparatus as claimed in claim 4 wherein the lamp flickers in the second indicating mode with a period of at most 10 msec.

6. An apparatus as claimed in claim 1 wherein the control means comprises means for performing a door opening operation for opening a door of the elevator cage.

7. An apparatus as claimed in claim 1 wherein the control means comprises means for performing a door closing operation for closing a door of the elevator cage.

8. An apparatus as claimed in claim 1 wherein the control means comprises means for performing a door closing operation for closing a door of the elevator cage when the registration request means is operated during a first time period with the indicating means operating in its second indicating mode and for performing a door opening operation for opening the door of the elevator cage when the registration request means is operated during a second time period subsequent to the first time period with the indicating means operating in its second indicating mode.

9. An apparatus as claimed in claim 8 wherein the indicating means comprises a lamp, and the control means comprises means for making the lamp flicker with a first frequency during the first time period and for making the lamp flicker with a second frequency different from the first frequency during the second time period.

10. A call registration apparatus for a multi-floor elevator system having an elevator cage with a door, the apparatus comprising:

a call button located in an elevator cage;

a call registration lamp located in the elevator cage;

a signal line having a first end connected to the call button and the call registration lamp and a second end;

a switching element connected to the second end of the signal line and having a first operating state permitting current to flow through the call registration lamp via the signal line and preventing a signal from the call button from being transmitted via the signal line, and a second operating state preventing current from flowing through the call registration lamp via the signal line and permitting a signal from the call button to be transmitted via the signal line;

means for registering a call when the call button is operated a first time during a period in which the switching element is in its second operating state and for performing a door control operation when the call button is operated a second time during a period in which the switching element is in its second operating states; and switching element control means for switching the switching element to its first operating state when the call button is operated the first time and for causing the switching element to oscillate between its first and second operating states when the elevator cage stops at a floor of the elevator system.

11. An apparatus as claimed in claim 10 wherein the switching element control means comprises means for causing the switching element to oscillate for a first length of time and for switching the switching element to its first operating state after the first length of time has elapsed.

12. An apparatus as claimed in claim 10 wherein the period of oscillation of the switching element is short enough for the call registration lamp to appear continuously illuminated to a viewer.

* * * * *